US007011020B2

(12) United States Patent
Dünninger et al.

(10) Patent No.: US 7,011,020 B2
(45) Date of Patent: Mar. 14, 2006

(54) PRINTING MACHINE BY INTAGLIO ENGRAVING

(75) Inventors: Brigitte Dünninger, Würzburg (DE); Georg Kahl, Karlstadt (DE)

(73) Assignee: KBA-Giori S.A., Lausanne (CH)

( * ) Notice: Subject to any disclaimer, the term of this patent is extended or adjusted under 35 U.S.C. 154(b) by 0 days.

(21) Appl. No.: 10/491,180

(22) PCT Filed: Oct. 22, 2002

(86) PCT No.: PCT/DE02/03977

§ 371 (c)(1),
(2), (4) Date: Mar. 30, 2004

(87) PCT Pub. No.: WO03/047862

PCT Pub. Date: Jun. 12, 2003

(65) Prior Publication Data

US 2004/0237816 A1 Dec. 2, 2004

(30) Foreign Application Priority Data

Nov. 27, 2001 (DE) ..... 101 58 093

(51) Int. Cl.
*B41F 9/02* (2006.01)

(52) U.S. Cl. ..... 101/152; 101/153; 101/177

(58) Field of Classification Search ..... 101/152, 101/155, 175, 153, 177, 183, 174
See application file for complete search history.

(56) References Cited

U.S. PATENT DOCUMENTS

| | | | | |
|---|---|---|---|---|
| 5,062,359 | A * | 11/1991 | Giori | 101/152 |
| 5,062,360 | A * | 11/1991 | Germann et al. | 101/152 |
| 5,282,417 | A * | 2/1994 | Germann | 101/152 |
| 5,899,145 | A * | 5/1999 | Schaede | 101/152 |
| 6,272,987 | B1 * | 8/2001 | Kamoda | 101/153 |
| 6,761,110 | B1 * | 7/2004 | Stark et al. | 101/170 |
| 2001/0035104 | A1 * | 11/2001 | Gottling et al. | 101/248 |

FOREIGN PATENT DOCUMENTS

| | | |
|---|---|---|
| EP | 0563007 A | 9/1993 |
| EP | 0873866 A | 10/1998 |

* cited by examiner

*Primary Examiner*—Andrew H. Hirshfeld
*Assistant Examiner*—Kevin D. Williams
(74) *Attorney, Agent, or Firm*—Clifford W. Browning; Woodard, Emhardt, Moriarty, McNett & Henry LLP

(57) ABSTRACT

The invention relates to a printing machine by intaglio engraving comprising a rack (01; 11; 14) with a stationary part (01) and a moving part (11; 14). A plate cylinder (07) is rotationally mounted inside the stationary part, and an Orlof-type cylinder (12) is mounted inside the moving part. The moving part is mounted on a rail (04) in a suspended manner.

9 Claims, 1 Drawing Sheet

PRINTING MACHINE BY INTAGLIO ENGRAVING

The invention relates to an intaglio printing machine as claimed in the preamble of claim 1.

Such a machine is known, for example, from EP 08 73 866 B1. This known printing machine has four gravure cylinders which are in each case supplied with ink from an associated inking unit. The surface of the gravure cylinder only receives ink at local depressions or countersunk spots. This ink is transferred to the ink-collecting cylinder which rotates in contact with all gravure cylinders. There is thus a layer of ink on the ink-collecting cylinder which may be made up of contributions from various gravure cylinders and may have a composition and coloring that varies from point to point. The plates of a plate cylinder that rotates in contact with the Orlof-type cylinder are colored by means of this layer of ink of varying composition, and the image on the plates is printed onto a printable material with a color distribution that is defined by the composition of the layer of ink, said printable material passing between the plate cylinder and a counter-pressure cylinder. A multicolored image which is inherently free of registration errors, since only a single printing plate is used, is thus printed onto the printable material with a single pass through the nip. This method is therefore preferably used to print papers of value such as, for example, bank notes.

Since the patterns of the depressions on the gravure cylinders are specific for each individual application of ink, it was important in older printing machines of this type for the gravure cylinders to be easily dismountable. The development of gravure printing plates has made it possible to no longer have to dismount the gravure cylinders. However, when this dismounting capability is omitted, in an intaglio printing machine of the conventional type known from EP 08 73 866 B1 the accessibility to the Orlof-type cylinder is highly restricted, and this makes cleaning thereof, for example, considerably more difficult.

DE 690 08 941 T1 discloses an intaglio printing machine for printing papers of value. In said document, plate and pressure cylinders are arranged in a stationary main rack, the ink-collecting cylinder and the ink selection roll are arranged in a first moving rack and the inking units are arranged in a second moving rack.

The object of the invention is to provide an intaglio printing machine.

According to the invention, this object is achieved by the features of claim 1.

The advantages that can be obtained by the invention are in particular that the Orlof-type cylinder is easily accessible for maintenance purposes without it being necessary to dismount a gravure cylinder. Instead, the printing machine may be provided with an interspace which ensures easy access to the Orlof-type cylinder by moving the Orlof-type cylinder away from the plate cylinder.

Since the first moving part of the rack, which bears the Orlof-type cylinder and expediently also the gravure cylinders, is arranged on a rail in a suspended manner, there is no need to fix or make corresponding rails in a complex manner on the floor of a hall or the like where the intaglio printing machine is set up.

A second moving part of the rack may be provided as a carrier for the inking unit of the gravure cylinder. By moving this second moving part away from the first moving part an interspace may also be created between inking unit and gravure cylinder, via which interspace it is easy for operating personnel to reach and clean the inking unit and the gravure cylinder and to easily exchange gravure printing plates.

One example of embodiment of the invention is shown in the drawings and described in more detail below.

Figure 1:
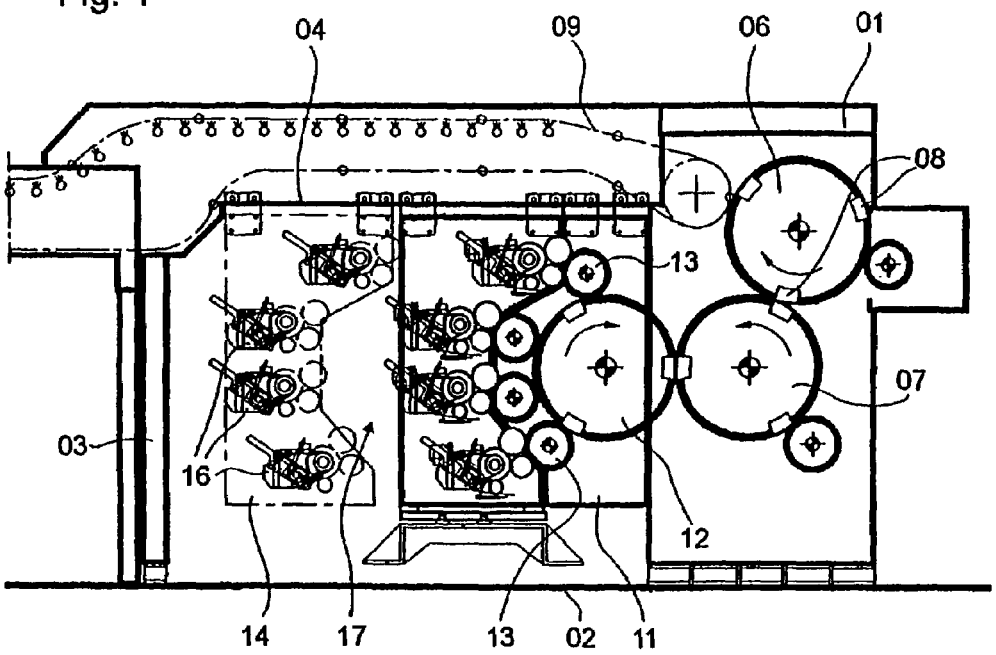
FIG. 1 shows a schematic longitudinal section through an intaglio printing machine in an operating position.

The rack of the machine shown in FIG. 1 is composed of a number of parts which in each case have two parallel, rigidly connected plates. A first stationary part 01 is fixed to the floor 02 of a hall or the like; its two plates, together with uprights 03 that are likewise supported on the floor of the hall, bear two parallel rails 04.

A counter-pressure cylinder 06 and a plate cylinder 07 are suspended rotatably in the stationary part 01. The direction of rotation thereof is indicated by arrows. The counter-pressure cylinder 06 is equipped with a number of grippers 08 which grip sheets that are fed in from the right in FIG. 1 in a manner that is not shown in any more detail, pass them through a nip between plate cylinder 07 and counter-pressure cylinder 06, where they are printed, and then transfer them to a gripper chain arrangement 09 from which they are passed via the rail 04 to an extension arm that is not shown in FIG. 1.

A first moving part 11 of the rack is suspended on the rails 04. The first moving part 11 bears an Orlof-type cylinder 12, that is to say a collecting cylinder, and a number of, in this case four, gravure cylinders 13 which rotate in contact with the Orlof-type cylinder 12.

A second moving part 14 of the rack, which is likewise suspended on the rails 04, bears four inking units 16, each of which in the position shown supplies ink to one of the gravure cylinders 13.

During operation of the printing machine, the rack parts 01; 11; 14 are arrested with respect to one another in the position shown in FIG. 1.

In order to be able to exchange the gravure printing plates on the gravure cylinders 13 for a new application of ink, the second moving part 14 can be moved out of its position shown as a continuous outline in FIG. 1 along the rail 04 into a maintenance position in which the second moving part 14 is shown as a dashed outline in FIG. 1. In this position, the second moving part 14 is only at a slight distance (e.g. less than 50 cm) from the upright 03, and an operating person can enter a passageway 17 (wider than 60 cm) that has been made between the second moving part 14 and the first moving part 11 in order to carry out maintenance work on the inking units and the gravure cylinders 13.

Figure 2:
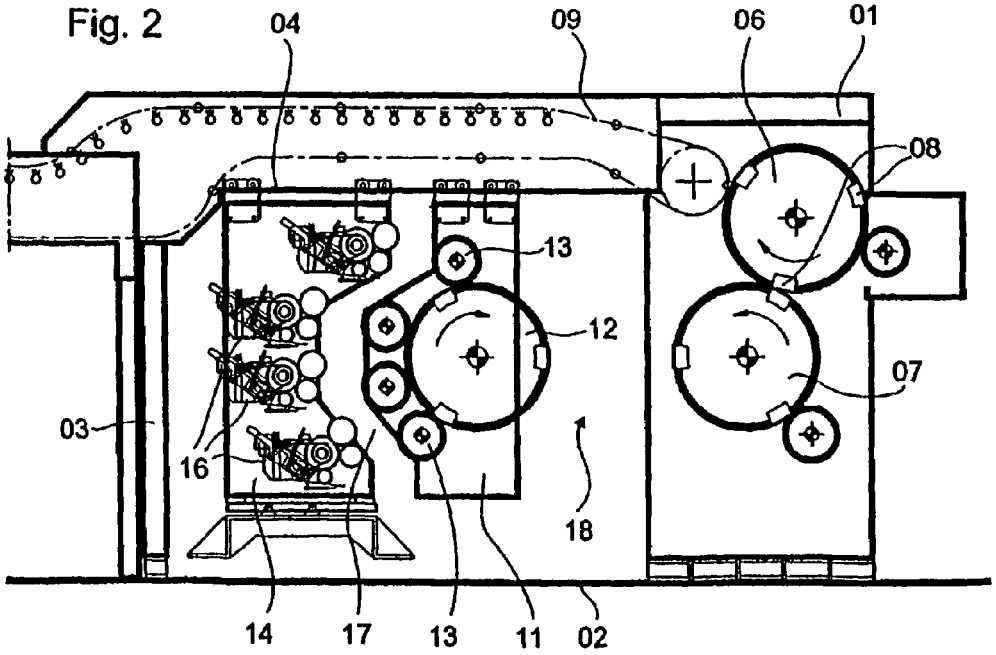
FIG. 2 shows a similar section through the intaglio printing machine in a cleaning and maintenance position.

In order also to be able to clean the Orlof-type cylinder 12 in a convenient manner without having to dismount the gravure cylinders 13, the first moving part 11 can likewise be moved in the direction of the upright 03, as shown in FIG. 2. While during displacement of the first moving part 11 a new passageway 18 (wider than 60 cm) opens up between the first moving part 11 and the stationary part 01 of the rack, the passageway 17 (smaller than 40 cm, in particular smaller than 30 cm) closes. The space requirement of the printing machine is therefore no greater than in the case of the printing machine according to EP 08 73 866 B1 which has already been cited; however, the access and maintenance possibilities are considerably improved.

The movement of the first part 11 and of the second part 14 takes place in each case by means of at least one dedicated actuator, e.g. an electric motor or pressure-activated working cylinder. The first part 11 and the second part 14 may be moved independently of one another. Thus the first part 11 is moved, for example, while the second part 14 remains stationary in its maintenance position.

Preferably, two actuators that are synchronized with one another are provided for each part 11, 14.

List of References

01 part, stationary
02 floor
03 upright
04 rail
05 -
06 counter-pressure cylinder
07 plate cylinder
08 gripper
09 gripper chain arrangement
10 -
11 part, first, moving
12 Orlof-type cylinder
13 gravure cylinder
14 part, second, moving
15 -
16 inking unit
17 passageway
18 passageway

What is claimed is:

1. An intaglio printing machine comprising a rack in which there are rotatably mounted an Orlof-type cylinder, a plate cylinder and at least one gravure cylinder, the rack comprising a stationary part, which bears the plate cylinder, and a first suspended moving part that can be moved with respect to said stationary part, and which bears the Orlof cylinder and at least one gravure cylinder, and a second suspended moving part that can be moved with respect to the stationary part and said first suspended moving part, which bears an inking unit for each gravure cylinder borne by said first suspended moving part, the first suspended moving part and the second suspended moving part being suspended from a rail located above said first and second suspended moving parts.

2. The intaglio printing machine as claimed in claim 1, wherein during operation of the intaglio printing machine said parts of the rack are arrested.

3. The intaglio printing machine as claimed in claim 1, wherein the stationary part and an upright support the rail and wherein in a maintenance position the second moving part is arranged at a slight distance from the upright.

4. The intaglio printing machine as claimed in claim 1, wherein at least one dedicated actuator is assigned to each moving part.

5. The intaglio printing machine as claimed in claim 1, wherein the first part moves and the second part is stationary.

6. The intalgio printing machine as claimed in claim 4, wherein the dedicated actuator is an electric motor.

7. The intalgio printing machine as claimed in claim 4, wherein the dedicated actuator is a pressure-activated working cylinder.

8. The intaglio printing machine as claimed in claim 4, wherein two actuators that are synchronized with one another are provided to move said first and second moving parts.

9. The intaglio printing machine as claimed in claim 1, wherein said Orlof cylinder, said first moving part and said rail are arranged in such a manner that a rotation axis of said Orlof cylinder is located vertically below said rail when said first moving part is in operating contact with the stationary part.

* * * * *